United States Patent [19]

Hise et al.

[11] Patent Number: 4,690,341

[45] Date of Patent: Sep. 1, 1987

[54] IMPACT CRUSHER ROTATING IMPELLER TABLE

[76] Inventors: Mason R. Hise, P.O. Box 732, Placitas, N. Mex. 87043; Neil R. Hise, P.O. Box 722, Placitas, N. Mex. 87048

[21] Appl. No.: 825,396

[22] Filed: Feb. 3, 1986

[51] Int. Cl.[4] ..... B02C 23/00

[52] U.S. Cl. ..... 241/275

[58] Field of Search ..... 241/275, 5

[56] References Cited

U.S. PATENT DOCUMENTS

| | | | |
|---|---|---|---|
| 3,578,254 | 5/1971 | Wood | 241/275 |
| 3,955,767 | 5/1976 | Hise | 241/275 |
| 4,090,673 | 5/1978 | Ackers et al. | 241/275 |

*Primary Examiner*—Timothy V. Eley

*Attorney, Agent, or Firm*—Robert W. Weig

[57] ABSTRACT

The disclosure relates to an improved rotating impeller table for a secondary impact crusher comprising a side discharge port containing housing incorporating dove tailed abrasion resistant wear elements disposed on the external cylindrical wall thereof. The dovetailed wear elements overlap and are supported by removable lower edge wear liners which also protect the outer edge area of the lower part of the housing. A removable top liner retains the dove tailed elements in position and protects the upper part of the housing from abrasion. A removable and repositionable wear ring fits within an annular opening in the top of the housing and may be repositioned at least three times to essentially triple its wear life. Upper and lower centrufugally locking flat and ramped liners are disposed within the housing on its upper and lower ends. Parallel planar vertical walls, deflection plates and pins adjacent the side discharge ports on the housing are uniquely structured and positioned to give extended wear and optimum results.

22 Claims, 15 Drawing Figures

IMPACT CRUSHER ROTATING IMPELLER TABLE

FIELD OF THE INVENTION

The invention relates to secondary impact crushers of the type used on site to reduce available aggregate to a completely fractured cubical product.

BACKGROUND OF THE INVENTION

Secondary impact crushers are usually utilized on site during the construction of roads, dams, buildings, storm sewers and the like to produce an aggregate of desired size from available materials, such as ores, perlite, quartz, marble asphalt mix aggregate, silica and concrete sand. In the building of roads and dams one must frequently make use of materials at hand. Secondary impact crushers provide for utilizing materials at hand to produce aggregate of a particular required size and nature.

The cost of producing a cubical product on site must be less than the cost of shipping it to the site for a secondary impact crusher to be considered an economical alternative for producing the desired product on site. Naturally, those skilled in the art are constantly attempting to lower the cost of producing the product on site from available materials.

Over the years the cost of producing a particular product has been brought down by improvements to various designs and components of secondary impact crushers. Such improvements are exemplified by those shown in U.S. Pat. No. 3,955,767 issued to Mason R. Hise, one of the inventors herein. The improvements set forth in this patent as well as others, such as U.S. Pat. No. 3,970,257 to MacDonald et al, improve the wear life of various components within impact crushers. The apparatus of the invention, as hereinafter disclosed, utilizes various components of novel structure, placement and composition to not only increase the wear life of such components, but to decrease the time and skill needed to reposition, replace and otherwise service such components.

One object of the instant invention is to provide increased component wear life in a secondary impact crusher.

Still another object of the present invention is to minimize on site down time for secondary impact crushers.

Another object of the invention is to provide a more economically operated secondary impact crusher.

Yet another object of the present invention is to better project the housing of a rotating impeller assembly in an impact crusher from abrasion.

One advantage of practicing the present invention is that cost of product is greatly reduced thereby.

Another advantage of the present invention is that an apparatus constructed and operated in accordance therewith is easier to maintain than those of the prior art.

SUMMARY OF THE INVENTION

In accordance with the present invention there is provided, in a vertical axis secondary impact crusher, a rotating impeller table assembly comprising, a side discharge port containing rotatable housing having cylindrical walls and upper and lower flat annular opposing end plates. A pair of vertical parallel planar aggregate deflecting wall elements are disposed between the annular plates and equidistantly oppose one another across the axis of rotation of the housing. Upper and lower aggregate deflecting liners comprising ramped and flat portions are removably mounted on the upper and lower plates inside the housing. Aggregate directing devices which preferably comprise deflector plate and pin combinations are specifically disposed at the areas of greatest aggregate pressure and therefore aggregate caused wear to direct aggregate out the side discharge ports onto impact surfaces located outside the housing. Bottom support liners and dove tailed castings are utilized as wear surfaces on the outside of the housing protect the outer edge of the lower annular plate and the outside of the cylindrical walls of the housing from abrasion. A removable top liner plate and multiple position wear ring are provided to protect the upper portions of the housing from abrasion.

BRIEF DESCRIPTION OF THE DRAWINGS

Other objects and advantages of the present invention will be apparent to those skilled in the art from the following detailed description of a preferred embodiment of the invention, with reference to the appended drawings, wherein like numbers denote like parts, and wherein.

DETAILED DESCRIPTION OF THE PREFERRED EMBODIMENT OF THE INVENTION

Figure 1:
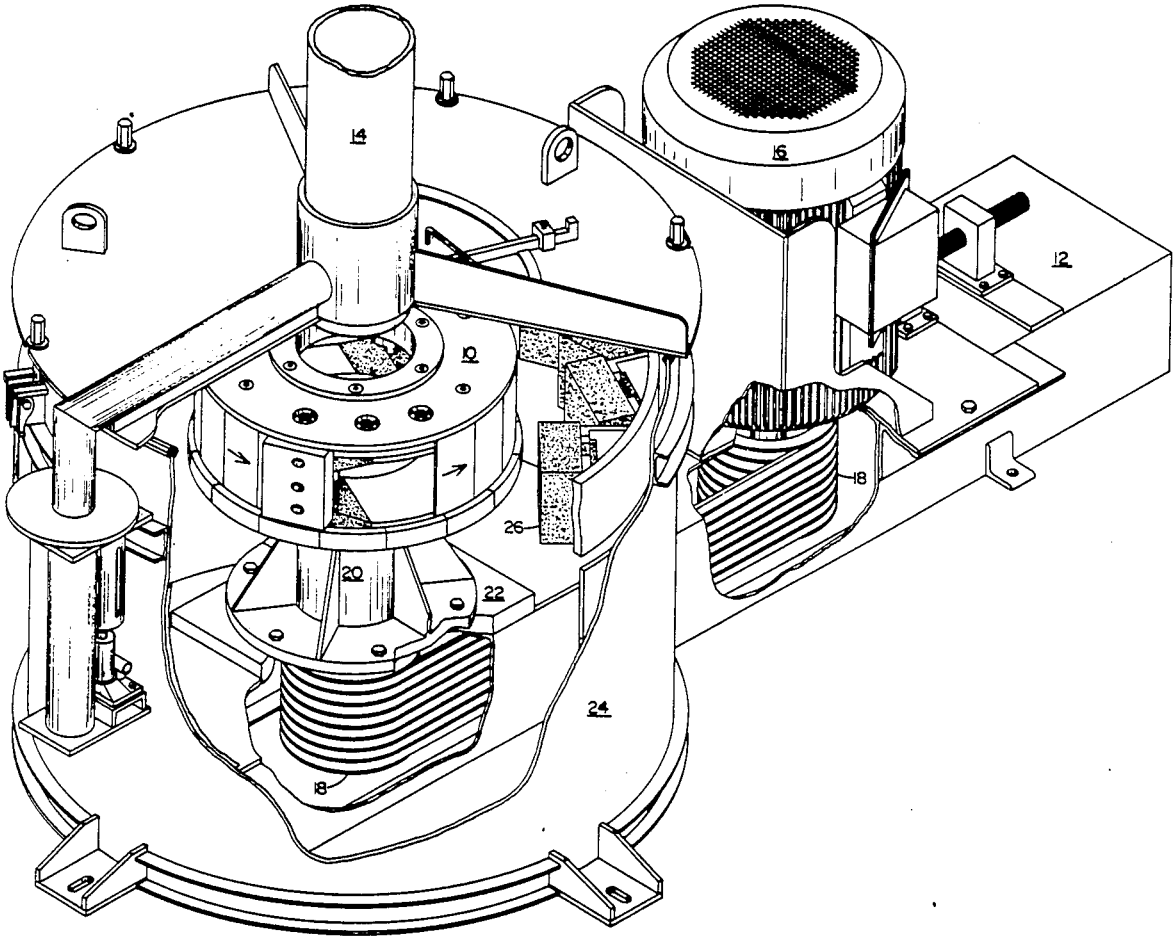
FIG. 1 illustrates a preferred embodiment of the invention within an impact crusher.

FIG. 1 shows a preferred embodiment of the invention 10. A conventional vertical axis impact crusher 12 containing the preferred embodiment 10 has a feed tube 14 for receiving and delivering to rotatable impeller table 10 materials to be broken into smaller particles of a desired size. The operation of such crushers is well known to those skilled in the art. The exemplary device illustrated uses an electric motor 16 which drives belts 18 to turn the rotatable impeller table 10 with sufficient speed to accomplish the desideratum of the invention. Impeller table 10 is affixed to an axle (not shown) passing through a pedestal 20 mounted on a box 22 within an external cylindrical crusher casing 24. Material from feed tube 14 passes into table 10, is accelerated outward by centrufugal force resulting from the rotation of the table, and is directed therefrom at great velocity through side discharge ports in the cylindrical walls of the table onto impact surfaces 26 disposed within casing 24 to break the impacting material into smaller pieces. It will be appreciated that the impeller table 10 operates in an extremely hostile environment within casing 24 because it is subject to abrasion from impacting material broken into small abrasive particles deflected from the impacting surfaces back at the table. Too, turbulent air between table 10 and casing 24 moves such particles at high speed within the casing 24 at the various exposed surfaces of the impeller table. Due to this highly abrasive environment in which the impeller table must operate it is important for operational usefulness and economy to construct the table for maximum life and minimum maintenance in such environmental conditions.

Certain surfaces within the impeller table such as deflector plates, pins and upper and lower liners hereinafter to be discussed are exposed to aggregate impact during operation, and they are designed, positioned and constructed for maximum wear life and easy replacement and adjustment. In practicing the invention advantage is taken of such readily replacable housing protecting wear parts wherever possible. The table rotates in the direction shown by the arrow on its side.

Figure 2:
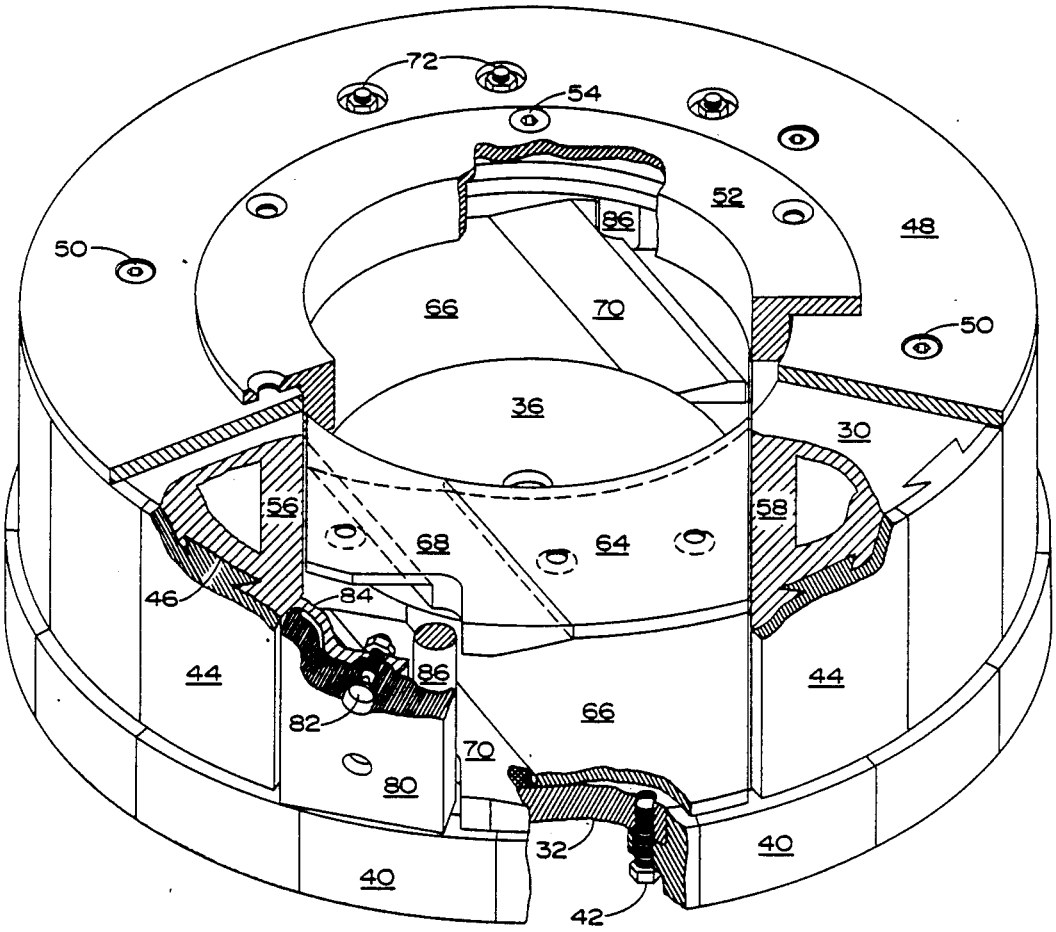
FIG. 2 shows the preferred embodiment in a cutaway view.
Figure 3A:
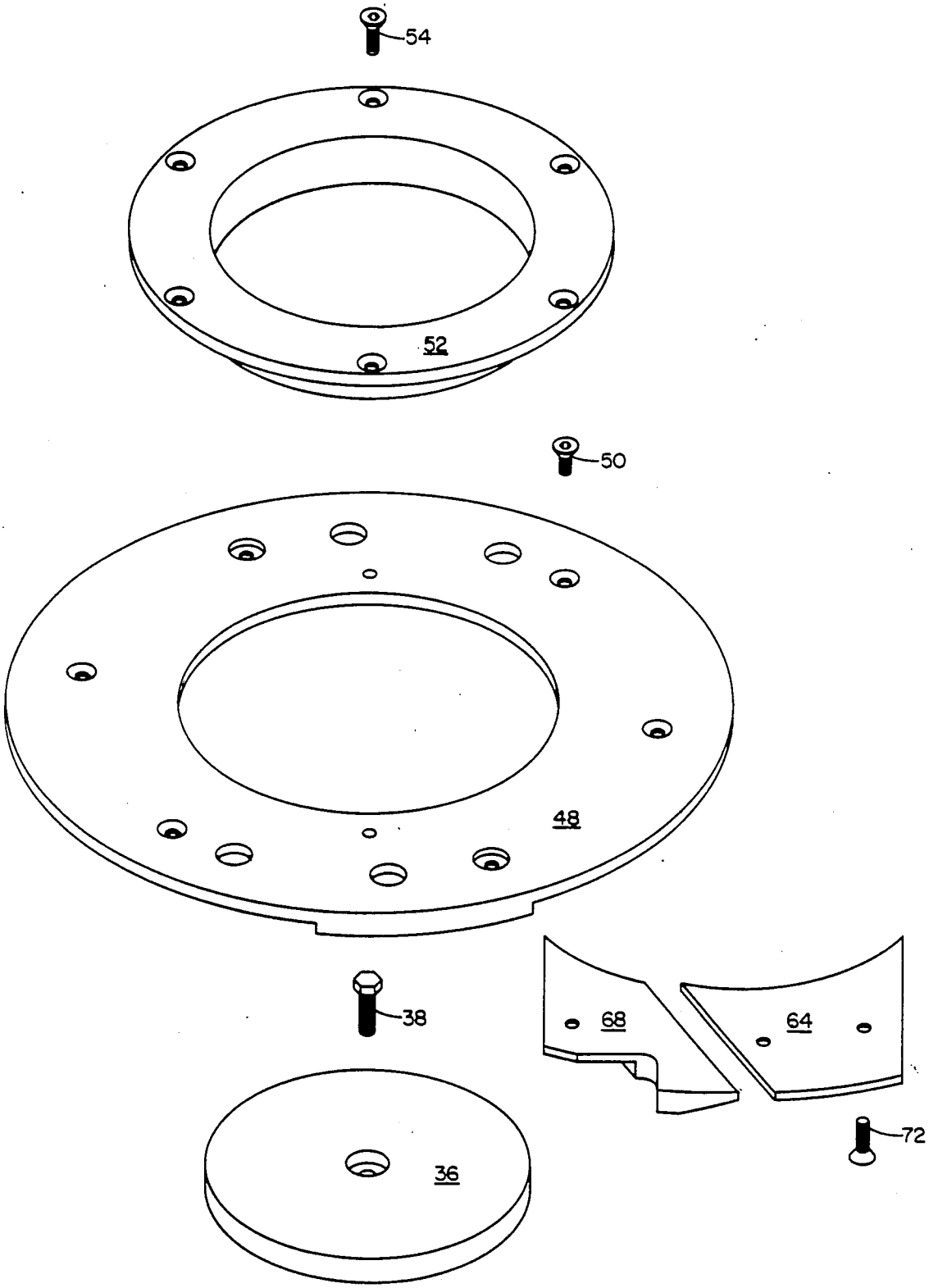
FIGS. 3A and 3B provide an exploded view of the preferred embodiment.
Figure 3B:
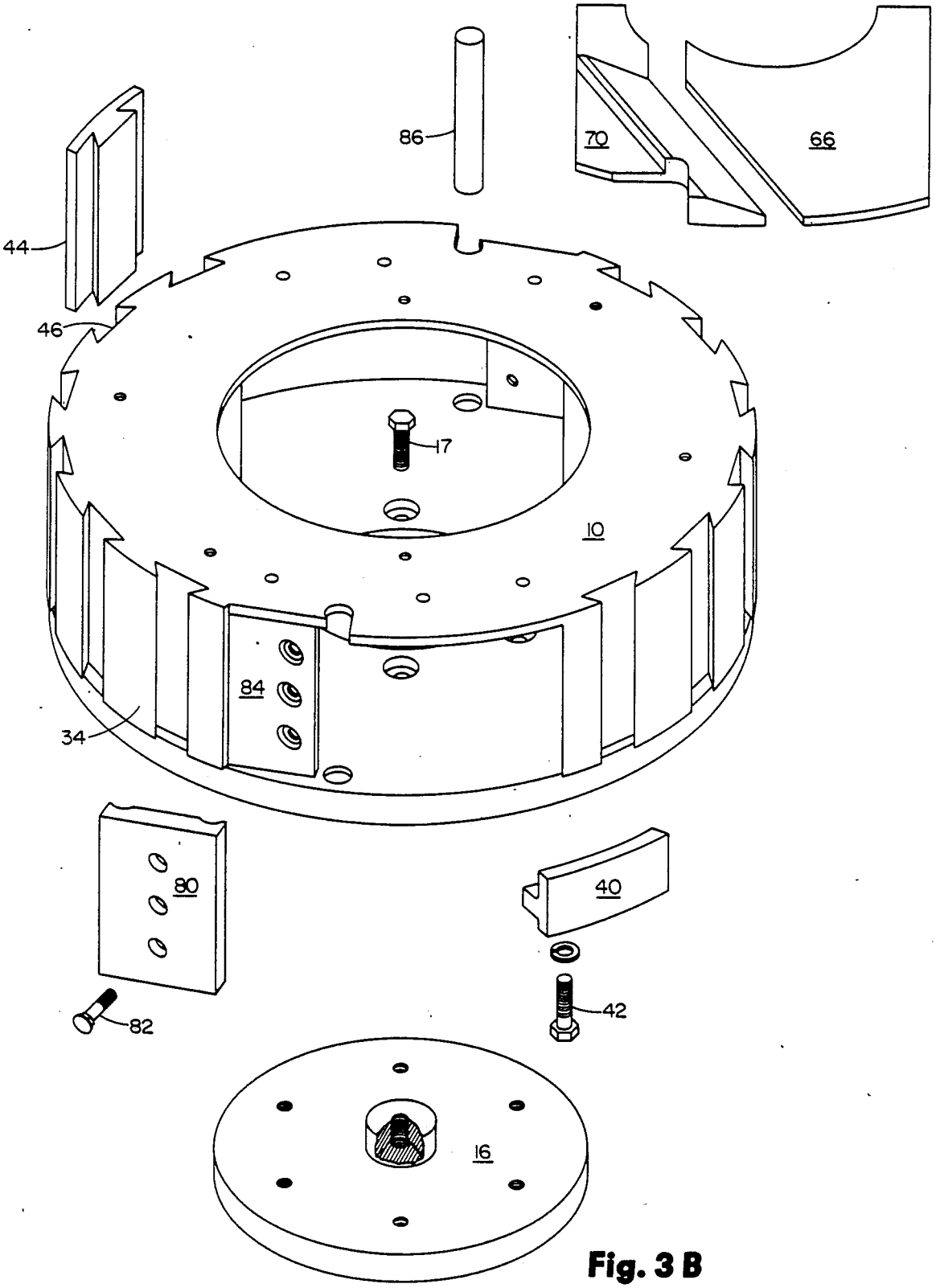
Figure 4:
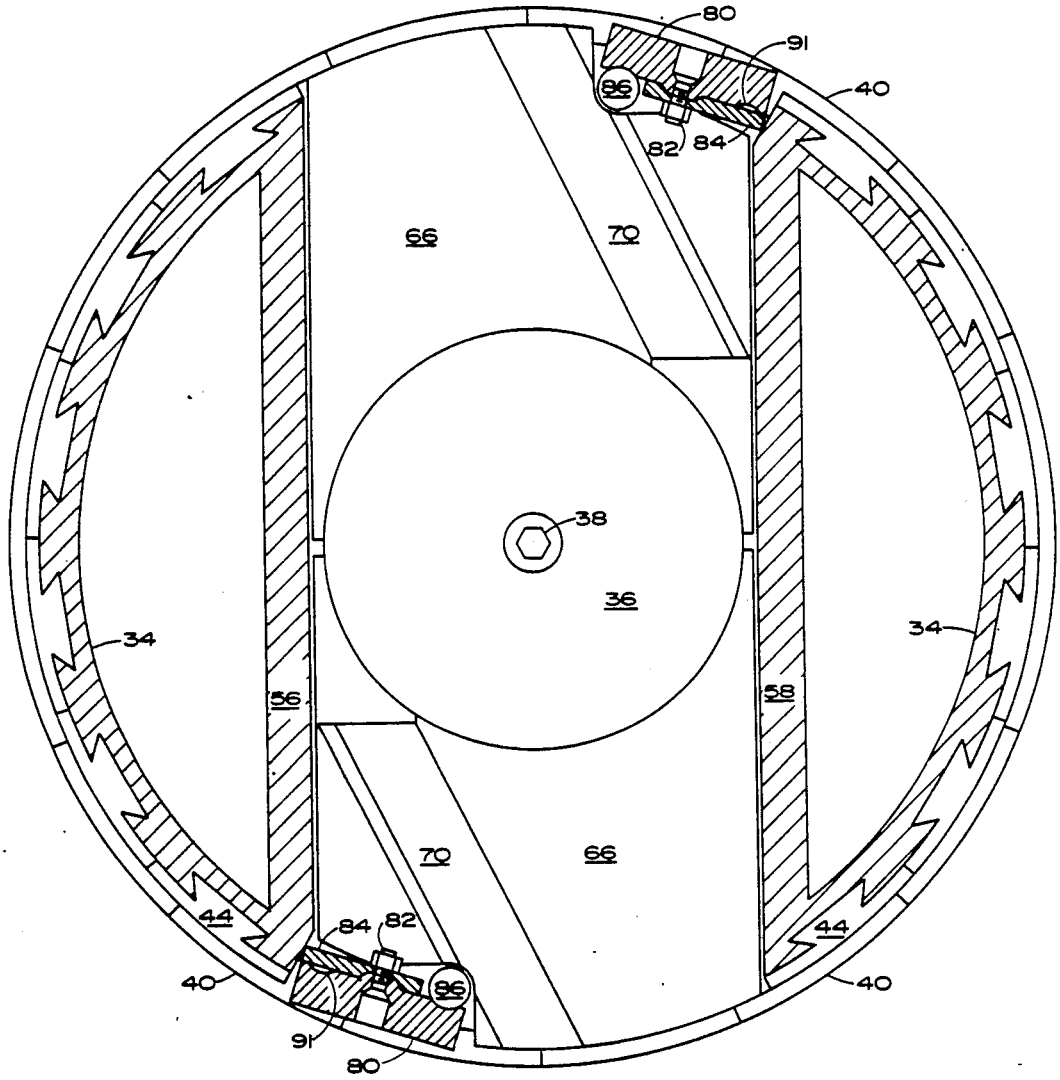
FIG. 4 is a top view of the preferred embodiment.
Figure 5:
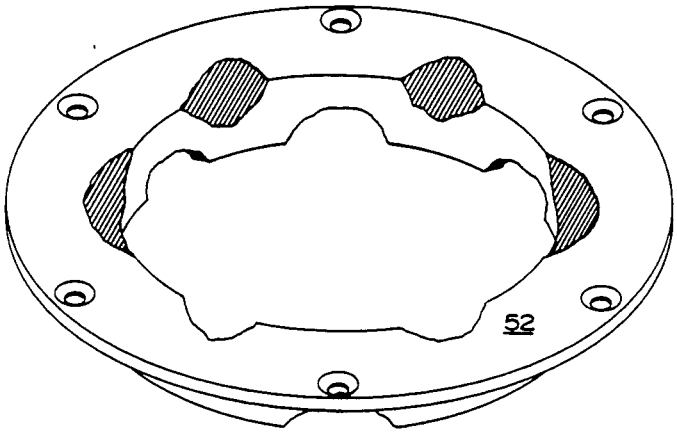
FIG. 5 shows a used wear ring.

Reference is now made to FIGS. 2, 3A and 3B. As seen therein the impeller table assemby comprises a rotatable housing comprising upper and lower flat annular opposing end plates 30 and 32 and side discharge port containing cylindrical walls 34 better seen in FIG. 4. In the preferred embodiment, plate 32, material flow controlling vertical wall elements 56 and 58 hereinafter to be discussed and cylindrical walls 34 are cast in one unit and plate 30 is attached thereto. A replacable center wear plate 36 within the annular center of bottom plate 32 is removably mounted to the axle of pedestal 20 with bolt 38. Bottom plate 32 bolts to a pedestal plate 16 with bolts 17. FIGS. 3A and 3B show these components. Plate 36 receives material gravitationally fed from the feed tube 14 and therefore sustains wear. Replacable bottom support liners 40 removably bolted to the outer edge of lower plate 32 with bolts 42 provide wear surface protection for the annular lower plate 32 as well as support for replacable overlapping dove tailed wear castings 44 which slide into dove tailed slots 46 in cylindrical walls 34. The overlapping feature of wear castings 44 is best seen in FIG. 4 and serves to maximize protection not only to the cylindrical walls of the housing but to the dove tailed slots therein and the dove tailed parts of the wear castings themselves by minimizing entry of abrasive particles produced by the crushing process into the dove tailed fittings of the cylindrical walls and the wear castings. Additionally, the dove tailed attachment in accordance with the invention provides a safety factor of 150% to oppose centrufugal force. A replacable annular top liner 48 bolts atop upper plate 30 with bolts 50. Top liner 48 provides a wear surface to protect the top or outside surface of upper plate 30 from abrasion and is easily replaced on site when worn. A replacable wear ring 52 for guiding material from the feed tube 14 into the impeller table 10 is repositionably mounted to top liner 48 with bolts 54. Wear ring 52 in the preferred embodiment is positionable in three positions at 120 degrees from one another and it wears as shown in FIG. 5. Its life in each position, when tested with a high abrasion aggregate material comprising 90% silica and having a Los Angeles abrasion value of 17 was about 40 hours. Thus, when replacable repositioned three times, it lasted about 120 hours. Wear ring 52 is preferably constructed from a high chrome white iron.

Replacable upper and lower flat liners 64 and 66 and upper and lower ramped liners 68 and 70 are disposed on the inside surfaces of the upper and lower flat annular plates 30 and 32, respectively. Upper liners 64 and 68 are preferably removably attached to top plate 30 with flat socket head bolts 72. The lower liners 66 and 70 need not be bolted in place for when the table is in operation, centrufugal force produced by its rotation holds liners 66 and 70 well in place against vertical wall elements 56 and 58. Liners 64, 66, 68 and 70 provide wear surfaces and are therefore structured, positioned and composed for maximizing wear resistance, preferably comprising a high chrome white iron. The ramped surfaces on upper and lower liners 68 and 70 slope at an angle between 18 and 26 degrees, preferably at an angle between about 20 and about 23 degrees, and are positioned at an angle between about 25 and about 21 degrees, preferably between about 27 and 29 degrees, to vertical wall elements 55 and 58. The ramped surfaces preferably rise from a thickness of about 7/16 to 9/16 inch to a thickness of about 1 7/16 to about 1 9/16 inches. They direct aggregate away from the liner surfaces to minimize wear on the flat liners and are themselves built up to a raised ramp to wear far longer than they would if flat. The ramp angles disclosed provide the longest wear life for the pins 86 and deflector plates 80 hereinafter discussed by providing excellent material flow control.

Figures 8, 9:
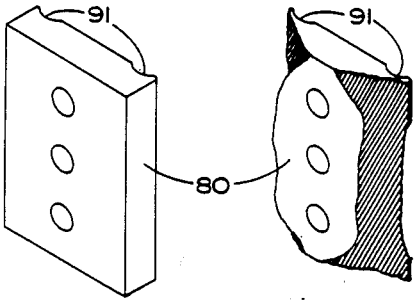
FIGS. 8 and 9 illustrate new and used deflector plates used in practicing the invention.
Figures 10, 11:
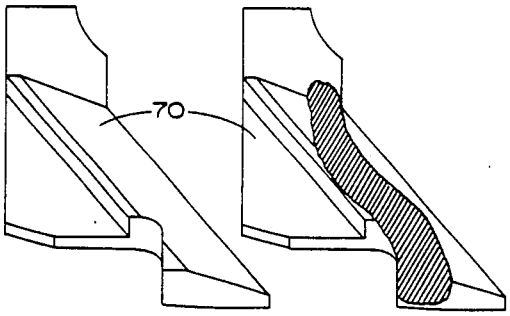
FIGS. 10 and 11 are perspective views of new and used ramped annular plate liners of the preferred embodiment.

Replacable deflector plates 80 are removably affixed to housing 10 adjacent each of the side discharge ports. Although in the preferred embodiment two side discharge ports are illustrated, those skilled in the art will appreciate that three or four side discharge ports may be appropriately spaced on an impeller table having a corresponding number and placement of ramped liners, deflector plates, and pins hereinafter to be discussed. Each deflector plate 80 is attached with three plowbolts 82 to a precisely located vertical fixed plate 84 which is permanently affixed to a cylindrical wall 34 of housing 10 at a preselected angle to vertical wall elements 56 and 58. In the preferred embodiment, the fixed plates 84 are disposed at an angle between about 110 and 130 degrees, preferable between about 115 and 121 degrees, to vertical wall elements 56 and 58. Replacable plates 80 are turnable 180 degrees to essentially double their wear life and are preferably constructed from high chrome white iron. FIGS. 8 and 9 show unused and twice used plates 80, respectively. The twice used plate 80 in FIG. 9 has been turned 180 degrees to obtain wear on two edges.

Figures 6, 7:
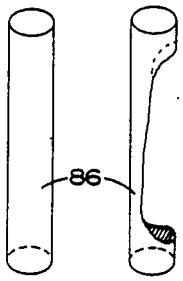
FIGS. 6 and 7 show new and worn disposable pins utilized in practicing the invention.
Figure 12:
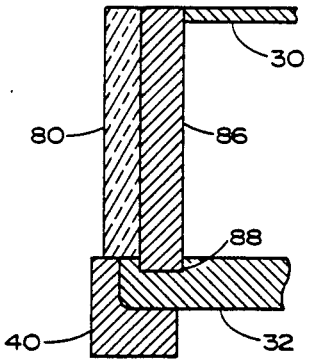
FIGS. 12, 13 and 14 show wear pin placement and support in cutaway, top and perspective views.
Figure 13:
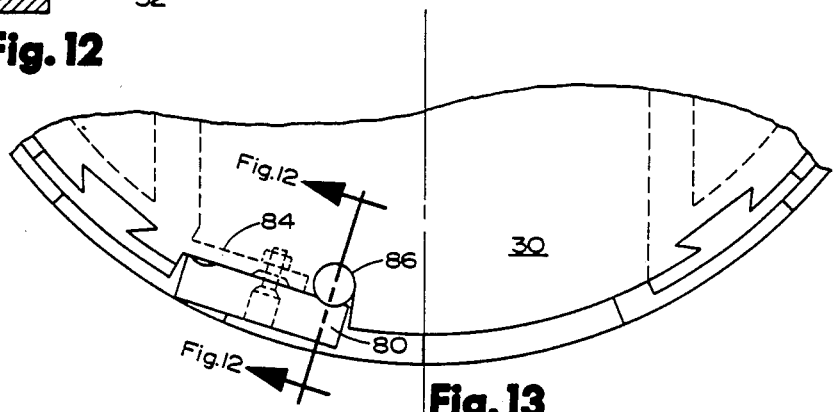
Figure 14:
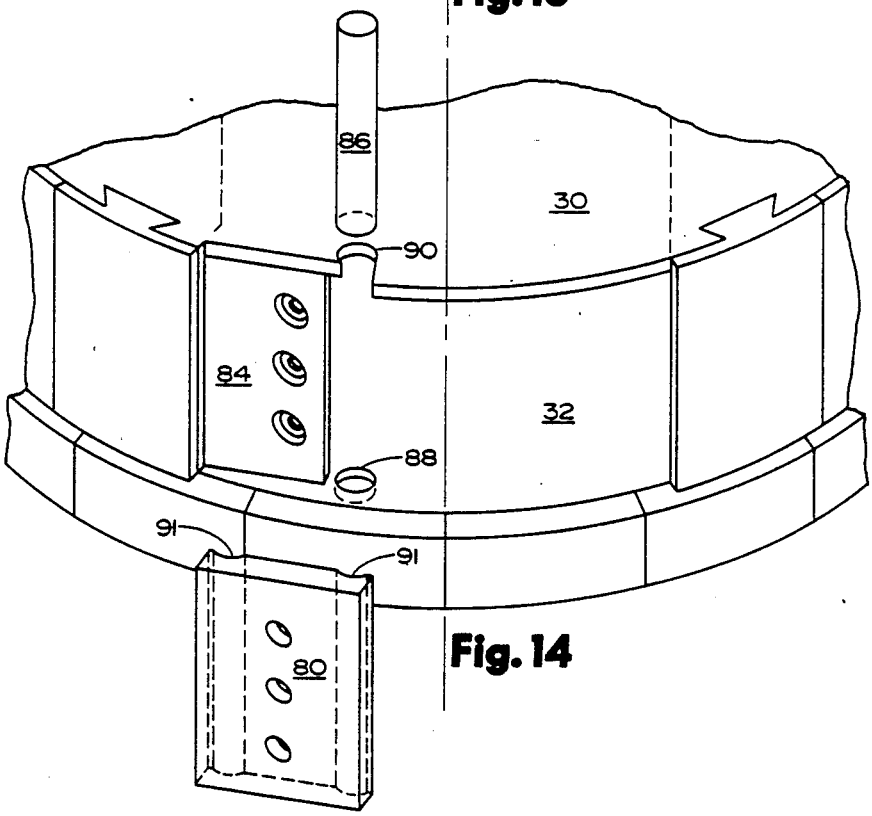

Replacable pins 86, as best seen in FIGS. 12, 13 and 14, are removably fitted within counterbored receptacles 88 in bottom plate 32 and retaining notches 90 in plate 30. Pins 86 are additionally supported against channels 91 on deflector plates 80. Pins 86 are preferably fabricated from a cobalt carbide alloy and in the preferred embodiment are approximately one and one-half inch in diameter, but may range from about one and one-fourth to one and three-fourths inch in diameter. Since about one and one-half inch diameter pins performed best in tests performed using the preferred embodiment, pins having between about one and one-fourth to one and three-fourths inch in diameter will last the longest. One inch and two inch pins were tested and did not wear nearly as long as pins one and one-half inch in diameter, which wore about 325 hours in tests with the LA 17 material hereinbefore described. Conventional state of the art shoes last only about eight hours under the same conditions. FIGS. 6 and 7 illustrate new and used pins, respectively.

The deflector plate 80 serves several important purposes. It provides backup support with its channel 91 for its adjacent pin 86 should an unforeseen large impact break the pin. Although as seen in FIG. 9 aggregate flow wears off the leading edge of plate 80, i.e., the edge abutting the discharge port, the plate still retains sufficient structure to continue supporting its adjacent pin.

The upper and lower ramp liners 68 and 70, vertical wall elements 56 and 58, pins 86 and deflector plates 80 combinations are precisely positioned relative to one another and to the side discharge ports to minimize wear to all of their wear surfaces during operation of the impeller table. The greatest aggregate induced wear and stress occurs at the points where aggregate is under the greatest forces and is moving at the greatest velocities, at and about deflector plates 80 and pins 86. Aggregate, centrufugally accelerated by the rotating table through contact with wall elements 56 and 58, forcefully moves outward against and over deflector plates 80 and pins 86, which are located at the points of maximum wear from aggregate contact and friction, out the side discharge ports.

In practicing the invention, readily replacable and repositionable elements, such as deflector plates 80 and wear ring 52, are utilized to protect and maximize the life of the housing. Furthermore, various other wear elements of the invention, such as, but not limited to, center plate 36, bottom support liners 40, top liner 48 and dove tailed wear elements 44 in accordance with the invention may be easily replaced in the field by relatively unskilled personnel.

The various features and advantages of the invention are thought to be clear from the foregoing description. However, various other features and advantages not specifically enumerated will undoubtedly occur to those versed in the art, as likewise will many variations and modifications of the preferred embodiment illustrated, all which may be achieved without departing from the spirit and scope of the invention as defined by the following claims.

What is desired to be secured as Letters Patent of the United States is:

1. In a vertical axis secondary impact crusher, a rotating impeller table assembly comprising:

a rotatable housing having upper and lower annular end plates and a vertical axis of rotation, said housing having cylindrical walls containing side discharge ports;

a pair of vertical substantially parallel planar aggregate deflecting wall elements disposed between and essentially perpendicular to said flat annular end plates, said wall elements opposing one another equidistantly across said axis of rotation; upper and lower aggregate deflecting means removably mounted on said upper and lower flat annular plates, respectively, within said rotatable housing, said deflecting means comprising separate flat and ramped portions; and means removably attached to said cylindrical walls for directing aggregate from said housing through said side discharge ports onto impact surfaces located outside said housing.

2. The invention of claim 1 wherein said aggregate directing means comprises a pair of vertically disposed removable deflector plate and cylindrical pin combinations.

3. The invention of claim 2 wherein said deflector plate is retainable at a preselected fixed angle to a planar wall element.

4. The invention of claim 3 wherein said fixed angle is between about 115 and 121 degrees to said wall element.

5. The invention of claim 2 wherein said pin is between at least about one and one fourth and one and three fourths inch in diameter.

6. The invention of claim 2 wherein said pin is between at least about one and three eighths and one and five eighths inch in diameter.

7. The invention of claim 2 wherein said pin comprises a cobalt carbide alloy.

8. The invention of claim 2 wherein said deflector plate is turnable 180 degrees to essentially double its wear life.

9. The invention of claim 1 wherein said upper and lower aggregate deflecting means are structured and disposed to lock into position under centrufugal force caused by rotation of said housing.

10. The invention of claim 1 wherein said ramped portions of said aggregate deflecting means slope from said flat plates to deflect aggregate toward central regions of said aggregate directing means.

11. The invention of claim 1 wherein corresponding upper and lower ramped portions are disposed opposite and essentially parallel to one another and positioned correspondingly from said axis of rotation of said housing.

12. The invention of claim 1 wherein said said ramped portions are disposed at a predetermined angle to said vertical planar wall elements.

13. The invention of claim 12 wherein said predetermined angle is between about 25 and 31 degrees to said wall elements.

14. The invention of claim 12 wherein said predetermined angle is between about 27 and 29 degrees to said wall elements.

15. The invention of claim 1 wherein said ramped portions incline at an angle between about 18 and 26 degrees to said flat portions.

16. The invention of claim 1 wherein said ramped portions incline at an angle between about 20 and 23 degrees to said flat portions.

17. The invention of claim 1 wherein said ramped portions incline from an edge thickness between about 7/16 and about 9/16 of an inch to an edge thickness between about 1 7/16 and about 1 9/16 inches above said flat portions.

18. The invention of claim 1 wherein said cylindrical walls, said lower flat annular end plate and said planar vertical deflecting wall elements are cast as a unit.

19. In a vertical axis secondary impact crusher, a rotating impeller assembly comprising:

a housing having cylindrical wall means and top and bottom opposedly spaced parallel annular flat plates, said bottom plate having an outer edge;

a plurality of individually removable and replaceable bottom support liners affixable to said lower annular plate about its outer edge to protect said lower plate from abrasive wear and wherein said cylindrical wall means of said housing comprise vertically disposed dove tailed slots whereby dove tailed wear castings may be slidably positioned therein and supported by said bottom support liners.

20. The invention of claim 19 wherein said dove tailed wear castings comprise interlocking and overlapping outer portions to provide abrasion protection for said housing.

21. The invention of claim 19 further comprising an annular top liner removably affixable atop said top annular flat plate, said top liner being disposed to protect said housing from abrasion and to assist in maintaining said dove tailed wear castings in place.

22. The invention of claim 19 further comprising an indexable wear ring rotatably repositionable in at least three separate positions atop said annular top liner.

* * * * *